US006092448A

United States Patent [19]

Cartwright et al.

[11] Patent Number: 6,092,448

[45] **Date of Patent: *Jul. 25, 2000**

[54] SLICER WITH STAGED DYNAMIC BRAKING SYSTEM

[75] Inventors: Richard W. Cartwright, Piqua; Joseph Chunchi Huang, Dayton; Brian Eric Bader, Springfield, all of Ohio

[73] Assignee: Premark FEG L.L.C., Wilmington, Del.

[ * ] Notice: This patent is subject to a terminal disclaimer.

[21] Appl. No.: 09/235,361

[22] Filed: Jan. 21, 1999

Related U.S. Application Data

[63] Continuation of application No. 08/784,482, Jan. 17, 1997, Pat. No. 5,862,730.

[51] Int. Cl.[7] ..... B26D 7/00; B26D 5/22

[52] U.S. Cl. ..... 83/42; 83/13; 83/62; 83/76.9; 83/364; 83/932; 83/707; 83/713; 83/730; 192/143

[58] Field of Search ..... 192/143; 83/13, 83/23, 29, 56, 68, 72, 62, 58, 76.8, 76.9, 932, 730, DIG. 1, 703–713, 591, 364, 365, 42, 435.16, 435.2

[56] References Cited

U.S. PATENT DOCUMENTS

| | | | |
|---|---|---|---|
| 1,808,645 | 6/1931 | Faehrmann | 188/174 |
| 1,824,949 | 9/1931 | Folk | 83/407 |
| 2,147,939 | 2/1939 | Tishken | 188/135 |
| 2,785,710 | 3/1957 | Mowery | 143/157 |
| 3,442,312 | 5/1969 | Karp | 146/102 |
| 4,059,173 | 11/1977 | Specht et al. | 188/110 |
| 4,074,602 | 2/1978 | Brower | 83/471 |
| 4,241,302 | 12/1980 | Benjamin | 318/758 |
| 4,478,119 | 10/1984 | Larson | 83/42 |
| 4,532,840 | 8/1985 | Antonissen | 83/71 |
| 4,813,316 | 3/1989 | Johnson et al. | 83/42 |
| 5,107,731 | 4/1992 | Kent | 83/91 |
| 5,442,841 | 8/1995 | McLeod et al. | 26/7 |
| 5,544,558 | 8/1996 | Hughes | 83/75 |
| 5,862,730 | 1/1999 | Cartwright et al. | 83/42 |

FOREIGN PATENT DOCUMENTS 2254142 5/1974 Germany .

*Primary Examiner*—Rinaldi I. Rada
*Assistant Examiner*—Boyer Ashley
*Attorney, Agent, or Firm*—Thompson Hine & Flory LLP

[57] ABSTRACT

A food slicer for automatic operation having a staged dynamic brake for bringing the slicer carriage to rest at a predetermined location in a smooth manner. A sensor or system of sensors are utilized to detect the slicer carriage location. The sensor output is fed through a microprocessor which controls a dynamic brake which in turn acts upon the slicer carriage. The brake acts upon the carriage in two or more stages, so as to bring the carriage to rest in a smooth manner. The invention may also operate to as to bring the carriage to rest in a predetermined location.

5 Claims, 4 Drawing Sheets

SLICER WITH STAGED DYNAMIC BRAKING SYSTEM

This application is a continuation of U.S. application Ser. No. 08/784,482 filed Jan. 17, 1997, now U.S. Pat. No. 5,862,730.

BACKGROUND OF THE INVENTION

The present invention relates to a food slicer for automatic operation and, more particularly, to a food slicer with a staged dynamic brake for bringing the slicer carriage to rest in a predetermined location, such as the home location.

Commercial food product slicers are widely utilized as rapid and effective means of slicing meat, cheese, vegetables and other food products. Food product slicers commonly include a motor driven circular slicing blade, and a carriage to pass the food product over the blade. A motor is normally used to drive both the blade and the carriage. The carriage includes a carriage platform and a carriage support arm, and the carriage is reciprocatingly mounted such that when the slicer is in operation the carriage reciprocates in a linear, horizontal path, passing the food product over the blade. Under the prior art, food slicers have no controlled braking system. When the operator wished to terminate the slicing process, the operator switched the power switch to the off position, thereby terminating the power to the slicer motor. Once the power was terminated, the carriage continued to coast along its reciprocal linear path until it came to rest in an arbitrary location.

Because the carriages of prior art slicers comes to rest in a variable and arbitrary location, several complications arise. For example, food slicers are often used to slice meat, such as roast beef, and heat lamps may be utilized to keep the food product warm when the slicer is not in operation. However, if the final carriage resting position is undetermined, the most efficient location of where to aim the heat lamp also remains undetermined. This uncertainty reduces the utility and effectiveness of the heat lamp.

Another drawback with the prior art slicers is due to the fact that the slicers may leave a piece of food dangling from the food loaf. When the carriage coasts to an arbitrary position, it can come to rest in a position where the blade is embedded in the food product such that it has made a partial cut of the food product, and the partial slice is left hanging from the food product loaf. This leaves the slicer and food product in a unattractive position for customers and consumers. The situation may additionally cause the partial slice to be wasted if it is left exposed to open air for too long.

A further drawback with the prior art slicers is due to the fact that when the food slicer operator wishes to replace or replenish the food product on the carriage, it is most convenient to have the carriage located as close to the operator as possible (termed the "home" position). Under the prior art, the carriage is often located in an inconvenient position, and the operator will have to move the carriage to the home position under his or her own power.

Accordingly, there exists the need for a food slicer that can return the carriage of a food slicer to a predetermined location. There also exists a need for a food slicer that can return the carriage to a predetermined location, where the predetermined location is the home position.

The applicants have developed an invention that will return the carriage of a food slicer to any predetermined location along the carriage path, including the home position. In the course of this discovery, the applicants further determined that when the carriage of a food slicer is brought to a sudden stop, the force of the braking procedure places a severe strain upon the internal mechanical components of the slicer. It was discovered that sudden one-step braking causes wear on the system and creates an undesirable clatter when the brake is applied. Accordingly, there exists the need for a food slicer that can bring the carriage to rest in a predetermined location in a smooth manner so as to avoid excessive wear on the internal mechanical components.

SUMMARY OF THE INVENTION

The present invention is a food slicer with a dynamic brake for bringing the slicer carriage to rest at a predetermined location in a smooth manner. The slicer includes a base, a circular rotating blade, a brake activation switch, a braking system, a carriage. The carriage includes a carriage platform and a carriage support arm, and is mounted for lateral reciprocating motion along a linear path to bring the food product into contact with the blade.

The braking system utilized in accordance with the present invention employs a sensor, or a network of sensors, to detect the location of the carriage. The sensor inputs are fed into a microprocessor or other logic device, which uses the sensor inputs to trigger the braking system such that the carriage is brought to rest in a predetermined location.

The present invention provides a food slicer for automatic operation food slicer for automatic operation, comprising a base; a circular blade mounted for rotation on the base; a carriage reciprocatingly mounted on the base, and being adapted to travel along a linear path crossing the blade, and having a surface adapted to support a food product and to bring the food product into contact with the blade; a motor drivingly connected to the carriage to produce the reciprocating motion of the carriage along the path, wherein the path of the carriage constitutes a linear segment with two end points, wherein the endpoint of the path further from the blade is designated the home position, and wherein the end point nearer to the blade is designated the knife position, and when the carriage is travelling from the home position to the knife position the carriage is termed to be travelling in the away direction, and when the carriage is travelling from the knife position to the home position the carriage is termed to be travelling in the toward direction; a sensor for detecting the position of the carriage along the path, with the sensor having a sensor output, wherein the sensor includes two positive feedback location sensors, wherein a first one of the positive feedback location sensors is located nearer to the knife position, and wherein a second one of the positive location feedback sensor is located nearer to the home position; a brake, responsive to the sensor output, for bringing the carriage to rest at or near a predetermined location along the path, wherein the brake is applied in a plurality of stages as the carriage travels along the path, the plurality of braking stages having a final brake stage, wherein the final brake stage is applied when the carriage is proximate to the predetermined location, the final brake stage operating so as to bring the carriage to rest at or near the predetermined location; a brake activation switch that can be activated, wherein the brake brings the carriage to rest after the brake activation switch is activated.

The invention further provides a method for braking the carriage of a food slicer, the slicer having a base, a blade, a sensor for detecting the location of the carriage, wherein the sensor includes two positive feedback location sensors with a sensor output, wherein a first one of the positive feedback location sensors is located nearer to the knife position, and wherein a second one of the positive location feedback sensor is located nearer to the home position, and a brake, the carriage being reciprocatingly mounted on the base, the carriage being adapted to travel along a linear path and having a surface adapted to support a food product and bring the food product into contact with the blade, the slicer further having a motor drivingly connected to the carriage to produce the reciprocating motion of the carriage along the path, wherein the path of the carriage constitutes a linear segment with two end points, wherein the endpoint of the carriage path further from the blade is designated the home position, and wherein the end point of the carriage path nearer to the blade is designated the knife position, and when the carriage is travelling in a path from the home position to the knife position the carriage is termed to be travelling in the away direction, the method comprising the steps of: detecting the location of the carriage along the carriage path with the sensor; activating the brake in response to the sensor output, the brake acting on the carriage to bring the carriage to rest, wherein the brake is applied in a plurality of stages as the carriage travels along the linear path, the plurality of stages having a final stage, the final stage being applied when the carriage is proximate to the predetermined location whereby the final stage operates so as to bring the carriage to rest at or near the predetermined location.

Other objects and advantages of the present invention will become apparent from the following description, the accompanying drawing and the appended claims.

DETAILED DESCRIPTION OF THE INVENTION

Figure 1:
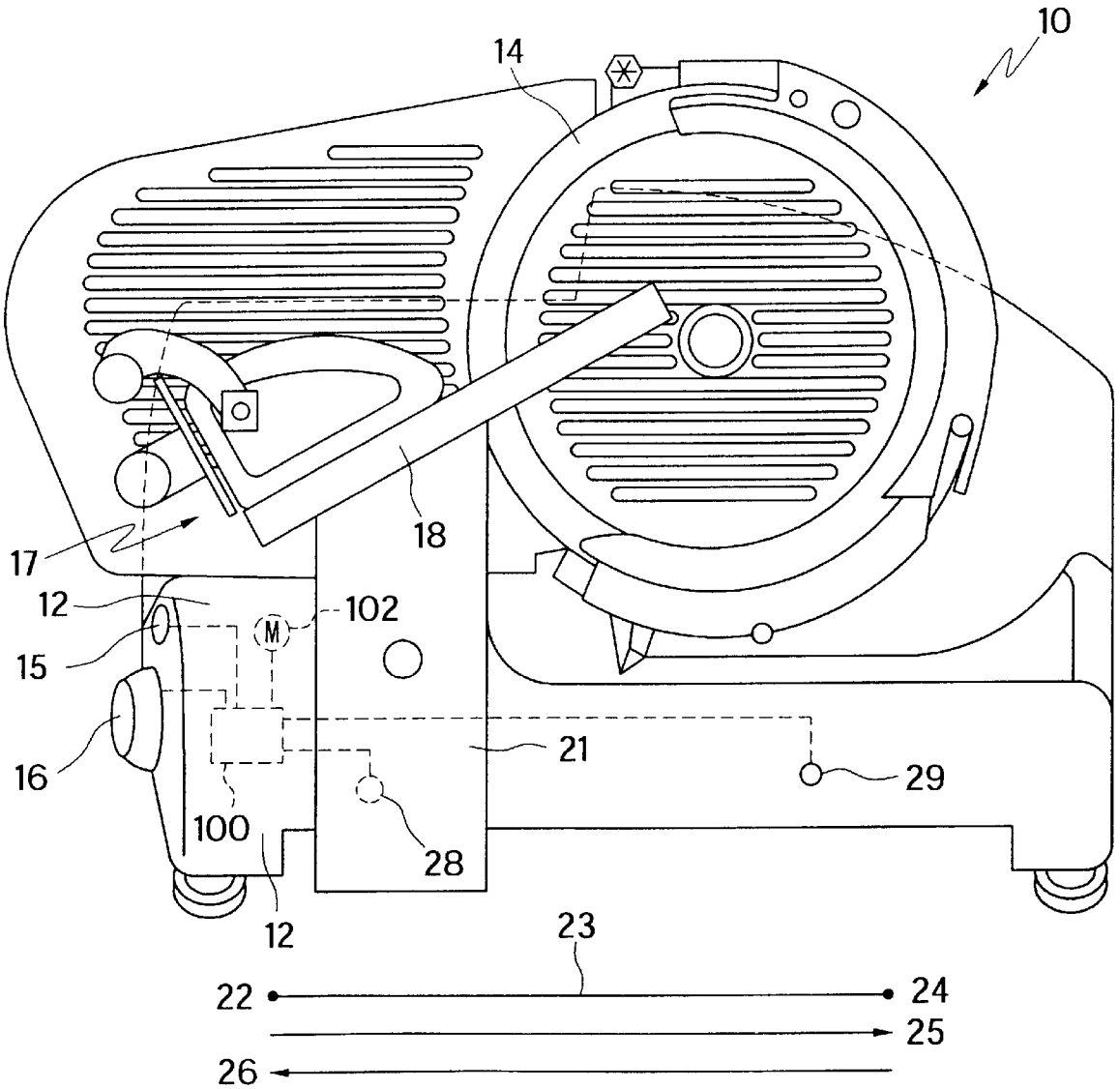
FIG. 1 is a side elevation of a slicer that may be utilized in accordance with the present invention.

FIG. 1 shows a food slicer 10 of the present invention. However, it should be here noted that the invention may be utilized in almost any configuration of food slicer, and the invention is not limited to the forms illustrated herein. The slicer 10 includes a base 12, a circular rotating blade 14, an on/off switch 15, a brake activation switch 16, and a carriage 17. The carriage 17 includes a carriage support arm 21 and a carriage platform 18 for supporting the food product. The carriage 17 is mounted for lateral reciprocating motion along a linear path to bring the food product into contact with the blade. The carriage support arm 21 is rigidly mounted to the carriage platform 18 and extends in the downward direction. The platform 18, carriage 17, and carriage support arm 21 reciprocatingly travel in a path that constitutes a line segment, represented as line segment 23, with two end points 22, 24. The endpoint of the carriage path that is nearer to the operator (not shown), and further from the blade, is termed the home position 22. The endpoint that is closer to the blade is termed the knife position 24.

The linear path along which the carriage reciprocates is resolved into two component paths 25, 26. When the carriage is travelling from the home position toward the knife position, it is termed to be travelling in the away path 25. On the other hand, when the carriage is travelling from the knife position toward the home position, it is termed to be travelling in the toward path 26.

In a preferred embodiment of the invention, two positive location feedback sensors or switches 28, 29 are utilized in conjunction with the braking system. The sensors (also termed "switches" interchangeably herein) are located along the reciprocating path of the carriage support arm 21 so as to detect the linear position of the carriage support arm 21, and thus the carriage 17.

When the carriage support arm passes by a particular sensor, that sensor is termed to be "activated" and it provides feedback to the microprocessor or other logic device (not shown). In accordance with the present invention, the home sensor, or home switch, 28 is located proximate to the home position, but slightly offset in the blade (or knife) direction from the home position. Correspondingly, the knife sensor, or knife switch, 29 is located proximate to the knife position, but slightly offset in the home direction from the knife position.

The braking system is designed such that it commences the braking cycle only when the carriage is travelling in the away path 25, regardless of the carriage location when the operator signals the braking to begin. This is accomplished by programming the microprocessor or other logic device of controller 100 to commence the braking cycle after the brake activation switch 16 has been activated by the operator; and 1) the home sensor 28 has been activated, followed by 2) activation of the knife sensor 29. In other words, after the operator has activated the system, once when the knife sensor 29 is activated after the home sensor 28 has been activated, the braking cycle is commenced. In this manner, it is ensured the carriage 16 is travelling in the away path 25 when the braking cycle is commenced. It should be noted that all of the steps described herein are controlled by a microprocessor or logic circuitry that receives sensor outputs and relays the outputs to the brake system. However, those skilled in the art will appreciate that any of a number of different logic processors may be used for the same purpose.

After the carriage passes the knife sensor location in the away path, the power to the slicer motor is terminated. There is then a delay of a predetermined length of time, e.g., about 75 milliseconds, to allow A/C current in the motor to decay before the first dynamic braking stage is applied.

The next step is the application of the first of two braking stages using a dynamic brake 102. Dynamic brakes are well known in the art, and utilize the motor that normally drives an item to operate as a brake on the same item when a direct current is applied across the motor. In the present invention, the dynamic brake is applied by passing a direct current across the A/C induction driving motor, which causes the motor to act as a dynamic brake to stop or slow down the carriage.

After the predetermined delay (75 milliseconds in the present embodiment), the first dynamic braking stage is applied in what is termed the "soft" braking stage. In one embodiment of the present invention, about 1.6 amps of direct current is utilized during the soft braking stage. The level of applied current may be varied to account for various factors, such as differing slicer configurations (such as carriage weight), variations in the motor specifications, and differing pre-braking speeds of the carriage.

Once the soft brake is activated, it is continuously applied as the carriage travels along its linear path until the carriage support arm reaches the home sensor 28. At this time the carriage will have reached the end of the away path, reversed direction, and will be travelling in the toward path all while the soft brake is applied. The soft brake stage normally slows down the carriage, but does not bring it to a stop. When the carriage reaches the home sensor 28, that sensor is activated, and it sends its output to the microprocessor. The microprocessor then actuates the "hard" brake, which is applied by increasing the level of current to the dynamic brake, thus increasing the applied braking force. In the current embodiment, the hard brake is applied at 2.5 amps of current. The hard brake is applied for a predetermined amount of time sufficient to ensure that the carriage is brought to rest. In the present embodiment, the hard brake is applied for roughly 1.5 seconds.

In the current embodiment of the invention, when the carriage nears the home position 22, the home sensor 28 is activated and the hard brake is applied at that time. The distance between the home sensor 28 and the home position 22 is such that when the hard brake is applied, the carriage is brought to rest at or near the home position. Furthermore, the two-staged braking of the present invention allows for smooth braking, and the wear on the internal components of the slicer due to sudden one-step braking is substantially reduced.

Figure 2A:
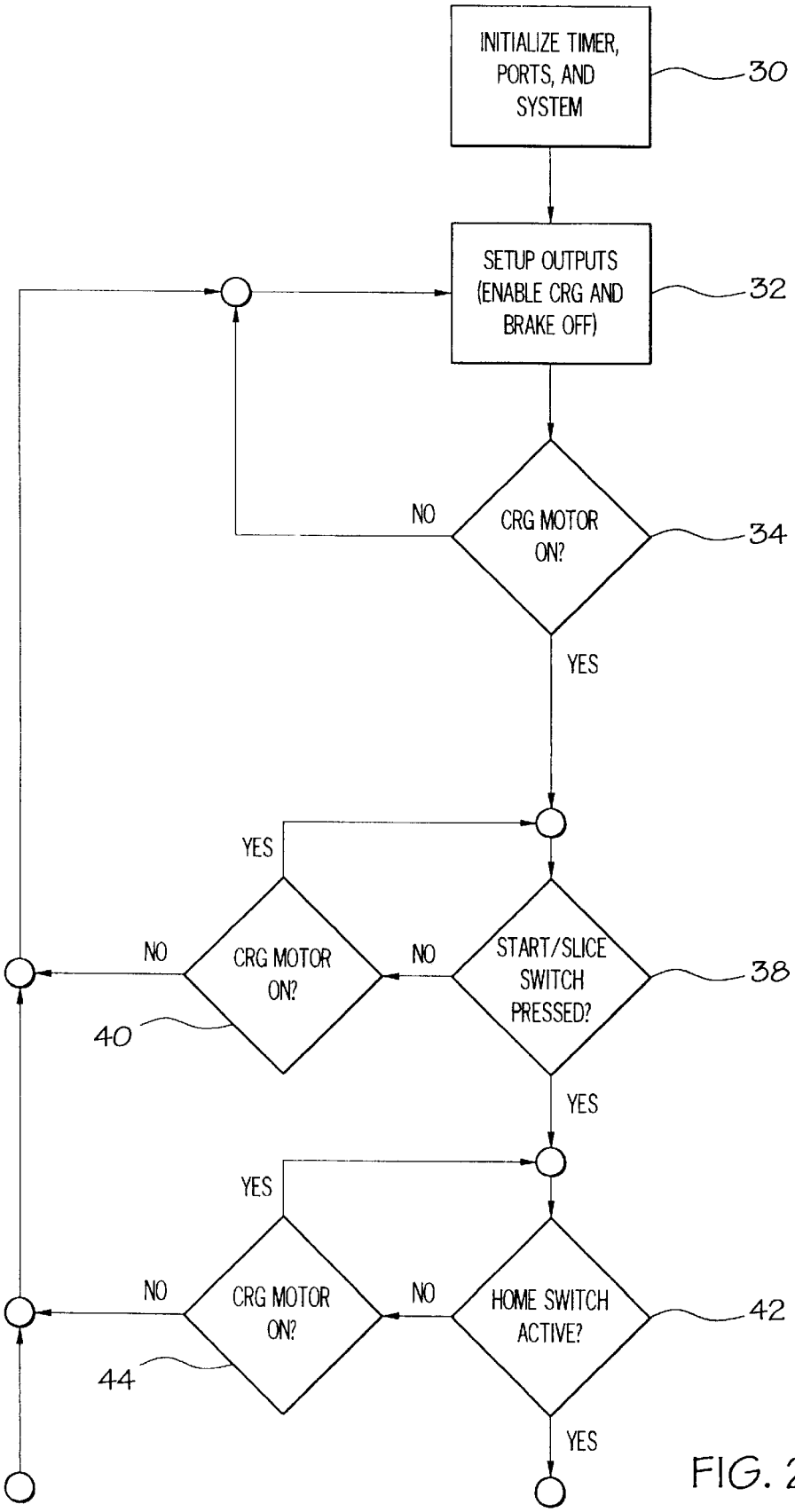
FIGS. 2A–2C together comprise FIG. 2, which is a flow chart diagram of the steps utilized to implement the present invention.
Figure 2B:
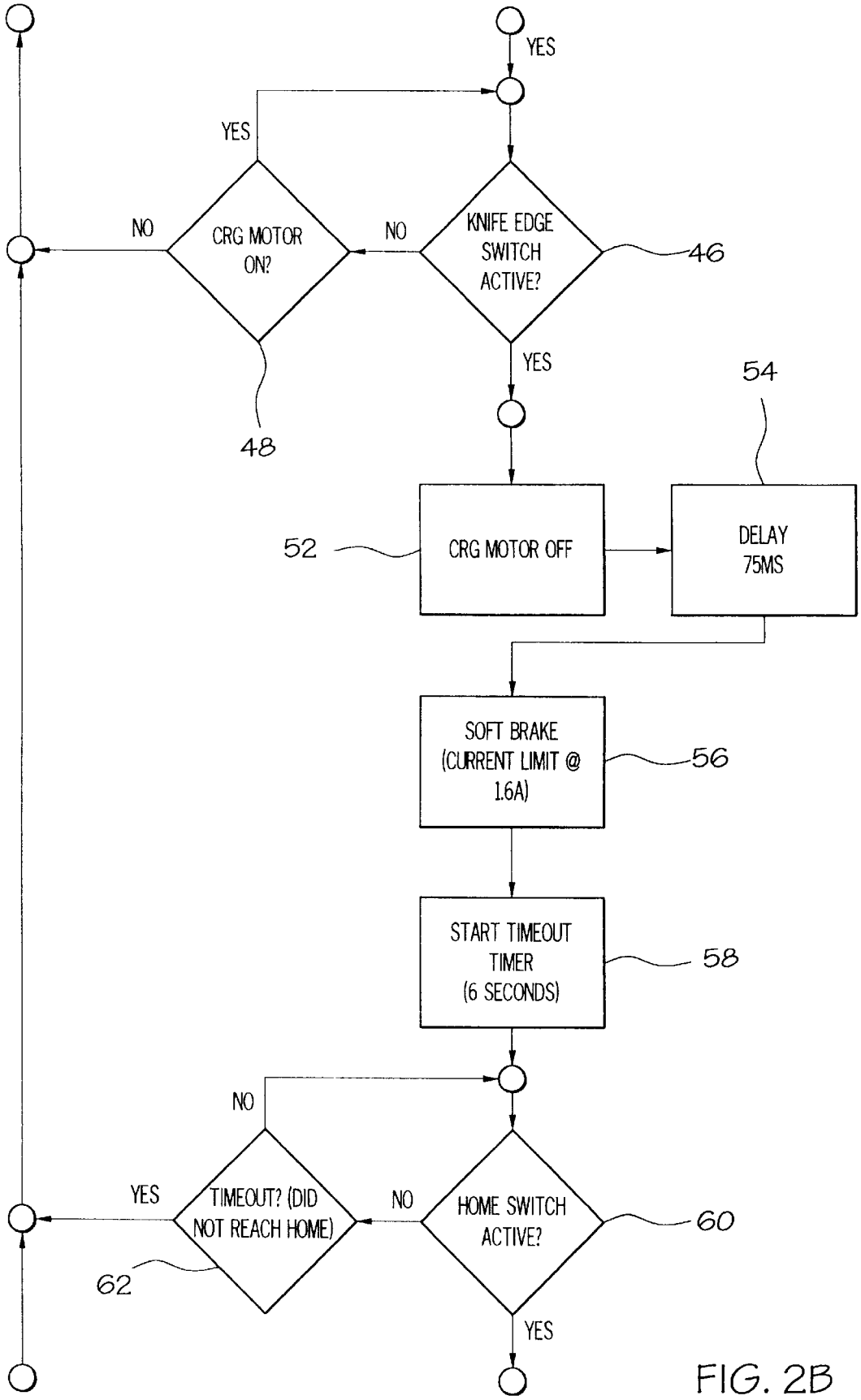
Figure 2C:
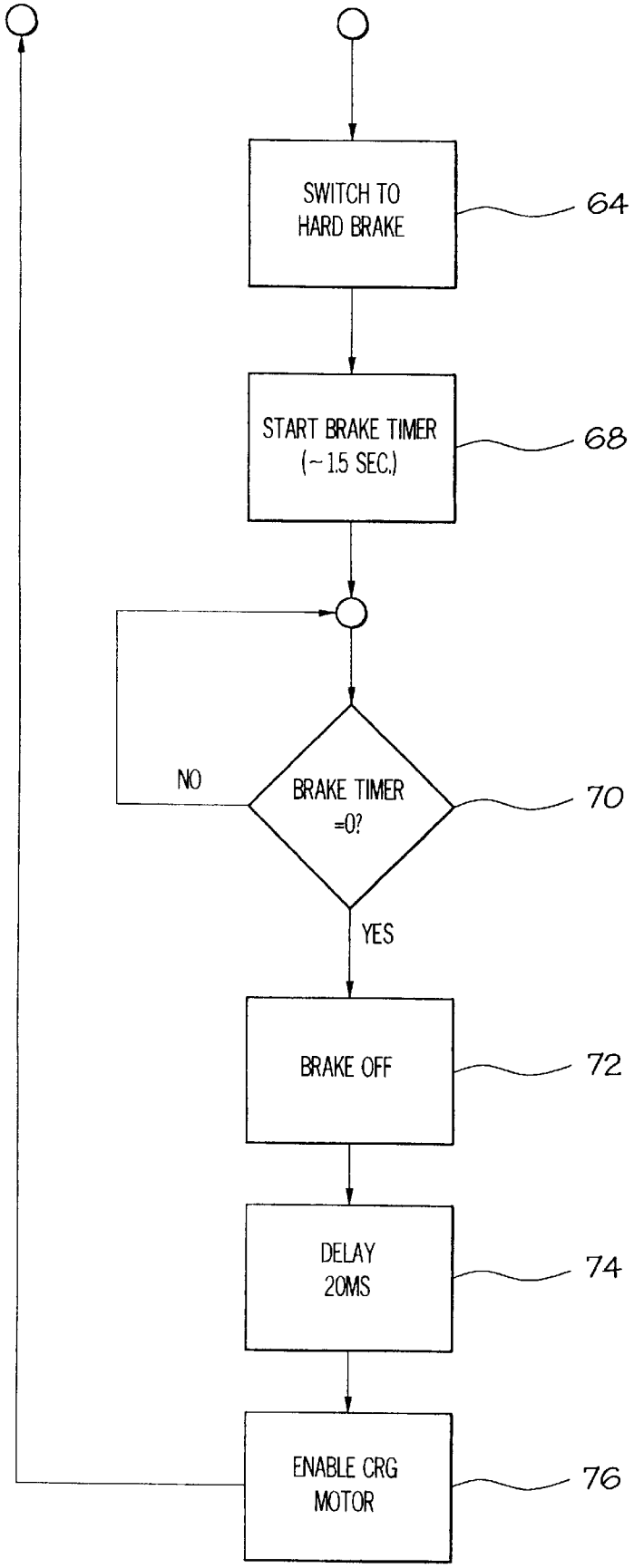

The flow chart diagram of FIG. 2 demonstrates the steps utilized in one embodiment of the current invention. At the first step, shown as step 30, the timer, ports, and systems are all initialized. At step 32, termed the "reset" step, the outputs are set up, as the carriage motor is enabled and the brake is switched to the OFF position. Step 34 is a decision step: if the carriage motor is on, the system progresses to step 36, and if the motor is not on, step 34 returns the system to the reset step 32.

Steps 38 and 40 form a control loop where the system resides until either the brake activation switch is pressed (which the operator presses to activate the braking cycle), or until the carriage motor is turned off. The brake activation switch is termed the "Start/Slice Switch" in FIG. 2. The system resides in this loop while the actual slicing of the food product is executed. The system exits this loop when either the brake activation switch is pressed by the operator or when the power to the carriage motor is terminated. If the brake activation switch is pressed, the system progresses to the next step of the flow chart via step 38. If the carriage motor is off, the system returns to the reset step 32 via step 40.

Steps 42 and 44 form another control loop, which operates so as to ensure that the home switch is activated before the system continues with the braking cycle. Ensuring that the home switch is activated is the first of the two steps carried out to ensure that the carriage is travelling in the away path before braking begins. The system exits this loop either when the home switch is activated, or when the carriage motor is turned off. If the home switch is activated, this means that the carriage arm has reach the home sensor and the system progresses to the next step via step 42. On the other hand, if the carriage motor is switched off while the system is in this loop, step 44 returns the system to the reset step 32.

Steps 46 and 48 form a similar control loop to ensure that the knife switch is activated before the system advances. The system exit the loop via step 46 when the knife switch is activated, or via step 48 when the carriage motor is switched off. The control loops of steps 42 and 44 and steps 46 and 48 operate so as to ensure that the home switch is activated followed by the activation of the knife switch, before the brake is applied. In this manner, it is ensured that the carriage is travelling in the away path before the braking cycle is continued.

After the system passes through step 46, the carriage motor is turned OFF at step 52. There is then delay (e.g. 75 milliseconds) at step 54 to allow the current in the carriage motor to decay before the dynamic brake is applied.

Step 56 is the implementation of the soft brake, where the dynamic brake is activated and held at 1.6 amps in this particular embodiment. Step 58 starts the timeout timer, which is used to switch the braking system OFF if the carriage support arm does not reach the home sensor within a predetermined amount of time after the application of the soft brake. The timeout timer is used to ensure that the system does not remain stuck in the soft brake stage if the carriage should not reach the home sensor for some reason.

Steps 60 and 62 form a control loop which the system exits either when the home sensor is activated by the passing of the carriage support arm, or when the timeout timer signals the system at step 62 to return to the reset step 32. If the carriage support arm reaches the home sensor, step 60 advances the system to step 64. Otherwise, if the timeout timer (set at 6 second in the current embodiment) expires, the system is returned to the reset step 32.

At step 64, the hard brake is applied in the form of a dynamic brake operated at 2.5 amps of current in the existing embodiment. At step 68, the brake timer, which controls the length of application of the hard brake, is started. Step 70 is a one-step loop in which the system resides until the brake timer reaches zero. The brake timer ensures that the hard brake is applied for a minimum length of time, which can vary, but in the present embodiment is about 1.5 seconds. At step 72, the brake is switched to the OFF position, followed by a delay (e.g. 20 milliseconds) to ensure that no braking force is being applied when the system progresses to the next step. At step 76, the carriage motor is enabled, and the system is then returned to the reset position at step 32. Once all of the above steps in the above-described embodiment have been carried out, the slicer carriage will have been brought to rest in the home position in a smooth manner, and the system is once again ready to begin slicing operations.

In an alternative embodiment of the invention, the carriage may be brought to rest at any predetermined location along the carriage path. The microprocessor can be easily programmed and the braking system adjusted so as to bring the carriage to rest at any predetermined location along the carriage path. The braking cycles and applied braking forces may also be varied by providing a differing number of braking stages, or altering the force and/or length of application of each braking stage. Furthermore, a single or multiple brake stages may be applied in a "ramp" force profile, where the force of the applied brake begins at a low level and increases with time. This ramp force profile brake may be used to decelerate the carriage so that it is brought to rest in a smooth manner.

While the forms of apparatus herein described constitute a preferred embodiment of the invention, it is to be understood that the present invention is not limited to these precise forms and that changes may be made therein without departing from the scope of the invention.

What is claimed is:

1. A method for braking a carriage of a food slicer, said slicer having a base, a blade mounted on said base, at least one sensor for detecting the location of said carriage, and a dynamic brake, said sensor having a sensor output, said carriage being reciprocatingly mounted on said base for travel along a linear path crossing said blade and having a surface for supporting a food product and bringing said food product into contact with said blade, said at least one sensor being positioned along said linear path, said dynamic brake positioned to brake the movement of said carriage along said linear path, wherein said linear path of said carriage includes a home position and a knife position, said home position being at the end of said carriage path furthest from said blade and said knife position being at the other end of said carriage path, and said carriage is traveling in an away direction when said carriage is traveling from said home position to said knife position, the method comprising the steps of:

detecting the location of said carriage along said carriage path with said at least one sensor;

applying said dynamic brake in a plurality of stages as said carriage travels along said linear path, said plurality of stages including a first stage and a final stage, a braking force applied during said final stage being greater than a braking force applied during said first stage, said brake being applied in said final stage when said carriage is proximate to a predetermined location whereby said final stage operates so as to bring said carriage to rest at or near said predetermined location;

wherein said slicer further comprises a brake activation switch operatively connected to said dynamic brake, said method comprising the further step of operating said brake activation switch prior to said applying step; and wherein said at least one sensor includes two sensors, wherein a first one of said sensors is located nearer to said knife position, and wherein a second one of said sensors is located nearer to said home position, said method comprising the further step of controlling application of said plurality of stages in response to detection of said carriage by said first and second location sensors.

2. The method as recited in claim 1 wherein said predetermined location is said home position.

3. A method as recited in claim 2, wherein said dynamic brake comprises an A/C motor which is also operable to drive said carriage further comprised of the following steps:

said brake activation switch is activated at which time said carriage is travelling at a pre-braking speed;

in response to detection of said carriage by said first sensor while said carriage is travelling in said away path, said A/C motor is deactivated by stopping delivery of an A/C signal thereto;

said A/C motor is applied as said dynamic brake in the first stage by delivering a first direct current thereto such that said carriage is slowed to a speed lower than said pre-braking speed;

in response to detection of said carriage by said second sensor, said A/C motor is applied as said dynamic brake in said final stage by delivering a second direct current thereto, said second direct current having a higher amperage than said first direct current, such that said carriage is brought to rest in said predetermined location.

4. A method for braking a carriage of a food slicer, said slicer having a base, a blade mounted on said base, at least one sensor for detecting the location of said carriage, and a dynamic brake, said sensor having a sensor output, said carriage being reciprocatingly mounted on said base for travel along a linear path crossing said blade and having a surface for supporting a food product and bringing said food product into contact with said blade, said at least one sensor being positioned along said linear path, said dynamic brake positioned to brake the movement of said carriage along said linear path, wherein said linear path of said carriage includes a home position and a knife position, said home position being at the end of said carriage path furthest from said blade and said knife position being at the other end of said carriage path, and said carriage is traveling in an away direction when said carriage is traveling from said home position to said knife position, the method comprising the steps of:

detecting the location of said carriage along said carriage path with said at least one sensor;

applying said dynamic brake in a plurality of stages as said carriage travels along said linear path, said plurality of stages including a first stage and a final stage, a braking force applied during said final stage being greater than a braking force applied during said first stage, said brake being applied in said final stage when said carriage is proximate to a predetermined location whereby said final stage operates so as to bring said carriage to rest at or near said predetermined location;

wherein said slicer further comprises a brake activation switch operatively connected to said dynamic brake, said method comprising the further step of operating said brake activation switch prior to said applying step; and wherein said at least one sensor detects a location of said carriage when nearer said knife position and detects a location of said carriage when nearer said home position, said method comprising the further step of controlling application of said plurality of stages in response to the location of said carriage as detected by said at least one sensor.

5. The method as recited in claim 4 wherein said at least one sensor includes two sensors, wherein a first one of said sensors is located nearer to said knife position, and wherein a second one of said sensors is located nearer to said home position, said method comprising the further step of controlling application of said plurality of stages in response to detection of said carriage by said first and second location sensors.

* * * * *